US005809941A

United States Patent [19]

Allaire

[11] Patent Number: 5,809,941

[45] Date of Patent: Sep. 22, 1998

[54] HIGH EFFICIENCY HOT WATER HEATER FOR RECREATIONAL VEHICLES AND BOATS

[76] Inventor: Ernest Lee Allaire, 31 Hadley Ct., Noank, Conn. 06340

[21] Appl. No.: 633,372

[22] Filed: Apr. 16, 1996

[51] Int. Cl.[6] ..... F24H 1/20

[52] U.S. Cl. ..... 122/13.2; 126/367; 126/360 R; 126/391

[58] Field of Search ..... 26/360 R, 391, 26/350 D, 362, 367, 387, 640, 641, 642; 122/14, 13.2, 17

[56] References Cited

U.S. PATENT DOCUMENTS

| | | | |
|---|---|---|---|
| 3,446,939 | 5/1969 | Morgan et al. | 392/461 |
| 3,446,940 | 5/1969 | Morgan | 219/318 |
| 3,502,843 | 3/1970 | Stryer | 392/454 |
| 3,614,386 | 10/1971 | Hepplewhite | 219/312 |
| 3,778,593 | 12/1973 | Wikström | 392/342 |
| 4,068,116 | 1/1978 | McKinstry | 219/523 |
| 4,085,308 | 4/1978 | Youngquist | 219/309 |
| 4,152,577 | 5/1979 | Leavines | 219/301 |
| 4,242,569 | 12/1980 | Kayser | 392/358 |
| 4,282,421 | 8/1981 | Hadar | 392/452 |
| 4,436,983 | 3/1984 | Solobay | 392/490 |
| 4,438,728 | 3/1984 | Fracaro | 122/14 |
| 4,452,226 | 6/1984 | Daugirda et al. | 126/373 |
| 4,620,667 | 11/1986 | Vandermeyden et al. | 236/20 R |
| 4,645,907 | 2/1987 | Salton | 392/485 |
| 4,651,714 | 3/1987 | Granberg | 126/378 |
| 4,676,199 | 6/1987 | Daugirda | 122/17 |
| 4,771,762 | 9/1988 | Bridegum | 122/17 |
| 4,818,845 | 4/1989 | Koizumi et al. | 392/462 |
| 4,835,366 | 5/1989 | Owen et al. | 392/499 |
| 4,875,465 | 10/1989 | Kramer | 126/391 |
| 4,894,516 | 1/1990 | Ellis et al. | 219/378 |
| 4,947,025 | 8/1990 | Alston et al. | 392/481 |
| 4,949,660 | 8/1990 | Despries et al. | 114/106 |
| 5,027,749 | 7/1991 | Cifaldi | 122/17 |
| 5,067,170 | 11/1991 | Nagashima et al. | 392/449 |
| 5,105,799 | 4/1992 | Wigdahl | 126/360 R |
| 5,187,772 | 2/1993 | Rumbley | 392/449 |
| 5,207,212 | 5/1993 | Woollen, Jr. | 126/391 |
| 5,278,941 | 1/1994 | Ward | 392/498 |
| 5,280,559 | 1/1994 | Lane | 392/344 |
| 5,293,446 | 3/1994 | Owens et al. | 219/449 |
| 5,299,329 | 4/1994 | Coustantini | 126/350 A |
| 5,307,958 | 5/1994 | Burrows | 222/146.1 |
| 5,325,822 | 7/1994 | Fernandez | 122/13.2 |
| 5,415,133 | 5/1995 | Noh | 122/17 |
| 5,429,041 | 7/1995 | Zitlel | 99/348 |
| 5,437,003 | 7/1995 | Blanco | 392/485 |
| 5,524,820 | 6/1996 | Regan | 126/350 R |

*Primary Examiner*—Henry A. Bennett
*Assistant Examiner*—Gregory Wilson

[57] ABSTRACT

An economical high efficiency convenience hot water heater is provided for use in boats and recreational vehicles and the like. The hot water heater is designed to be powered by 12 V.D.C. with a low power consumption. The tank assembly incorporates 2 horizontally installed insulated baffles which greatly improves thermal efficiency. The lower chamber is isolated and insulated to provide a quick water temperature rise in this chamber. The water after heating is drawn out for use in bathing, cooking, and the like.

7 Claims, 2 Drawing Sheets

HIGH EFFICIENCY HOT WATER HEATER FOR RECREATIONAL VEHICLES AND BOATS

BACKGROUND—FIELD OF INVENTION

This invention relates to a new high efficiency design hot water heater to be used in boats, recreational vehicles, and the like. The hot water heater is designed to use 12 Volts D.C. as a source of power. A capacity of 4 to 5 gallons is provided and water temperature is raised to 105° F. The overall shape of the water heater is 10"×14"×18" of rectangular form, although a cylindrical shape could be used. The unit is normally mounted on a floor or shelf. In the past water heaters have generally used 120 Volts A.C. or have utilized engine coolant water to heat water. Alternative hot water heaters have used gas combustion. For applications on vehicles that do not have these sources of power and or heat available, practical hot water is not available. Past configurations of water heaters are such that all of the water in the hot water tank is raised generally to 140° F. at once and is pressure fed through the tank. Some alternative hot water heaters are of the instant type and utilize generally gas combustion. This new configuration provides the user with hot water (105° F.) for bathing, cooking, and the like. This is provided within a reasonable time using 12 Volts D.C. to heat the water and not deplete an average size battery common to the industry. A further advantage is the hot water need not be mixed with cold and therefore does not need to be pressurized.

SUMMARY OF THE INVENTION

In accordance with the invention a new high efficiency water heater is provided for use in boats and recreational vehicles alike, hereinafter referred to to as vehicles. The said water heater provides hot water (105° F.) using only 260 Watts under average conditions per 24 hours and yields 4 gallons of heated water. In addition the water heater is designed for economical assembly on a production basis. In the preferred form the high efficiency water heater comprises a rectangular tank shape that houses 2 horizontal insulated dividers. The said tank also has installed an electric heater probe. The lower horizontal divider is fixed in place to isolate and insulate approximately 2 gallons of water. In this lower chamber the water is heated by the said electrical probe. The upper water chamber has installed an insulated floating baffle which increases the efficiency of the water heater. Heat transfer from the lower chamber to the upper chamber is accomplished by convection through a hole in said lower fixed divider which provides limited communication between the chambers. Temperature control is achieved by an external thermal sensor and over temperature protection is provided by a separate resettable sensor.

Figure 1:
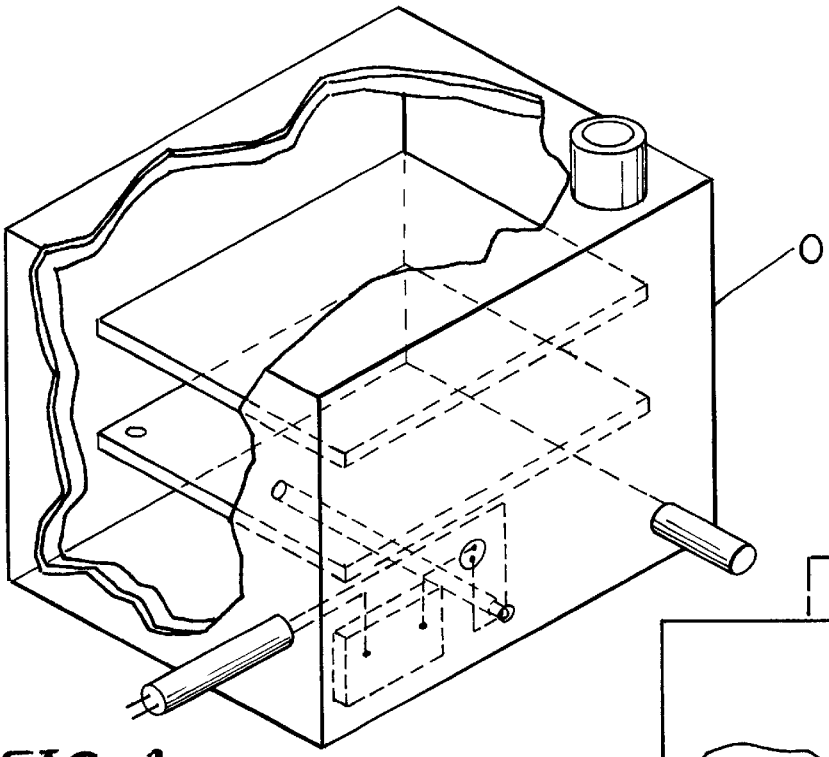
FIG. 1 is a fragmented perspective view illustrating a high efficiency hot water heater for vehicles.
Figure 2:
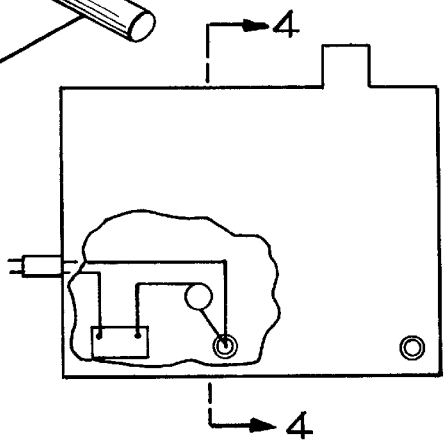
FIG. 2 is a front end elevation view of the water heater with a fragmented view showing the water heater's sensors and probe.
Figure 3:
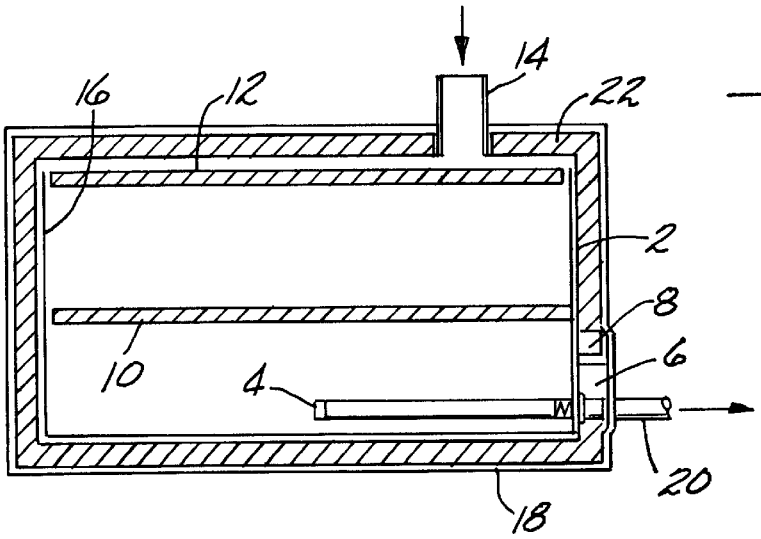
FIG. 3 is a longitudinal sectional view taken on the line 4.
Figure 4:
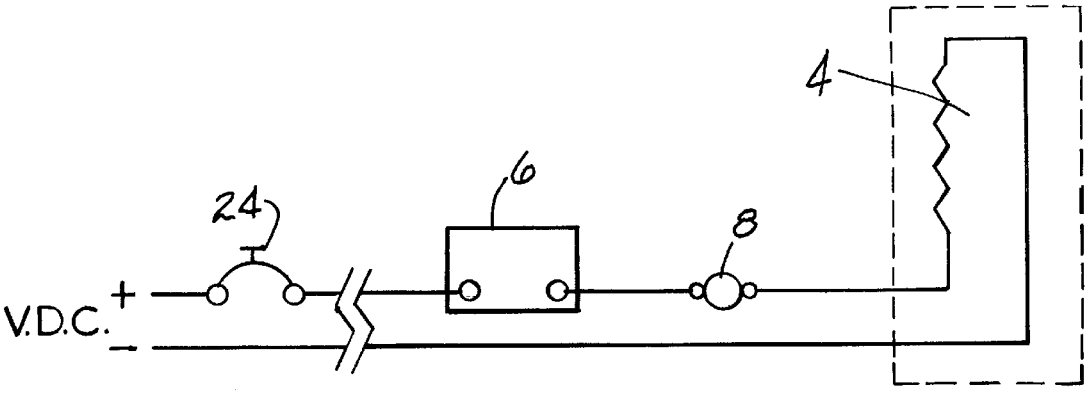
FIG. 4 is an electrical schematic.
Figure 5:
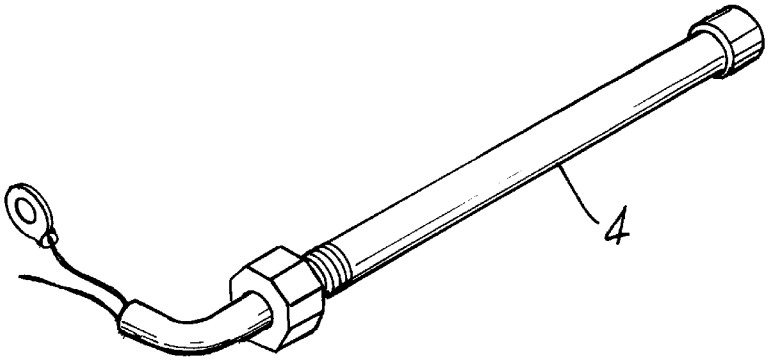
FIG. 5 is a view showing the heater probe.

| DRAWING REFERENCE NUMERALS: | |
|---|---|
| 0 | hot water heater |
| 2 | Tank |
| 4 | Heater probe |
| 6 | Thermal sensor |
| 8 | Over temperature sensor |
| 10 | Fixed lower divider |
| 12 | Floating divider |
| 14 | Tank filler port |
| 16 | Reflective Coating |
| 18 | External jacket |
| 20 | Water exit fitting |
| 22 | Insulation |
| 24 | Circuit breaker |

DETAILED DESCRIPTION OF THE PREFERRED EMBODIMENT

As shown in the exemplary drawings, a high efficiency water heater for vehicles is referred to generally in FIG. 1 by the reference numeral 0 wherein the heater is designed particularly for use in vehicles. The water heater 0 comprises a relatively low profile tank assembly suitable for installation in vehicles. The said tank 2 can be made of plastic or metal and is of a size to hold 4–5 gallons. The hot water heater 0 has installed a low wattage electric heater element or probe 4 for the purpose of raising the water temperature. This heater probe is positioned close to the bottom of the water tank 2. The said heater probe 4 is typically (but not limited to) 84 Watts at 12 Volts D.C. This energy demand is such as to not rapidly deplete an average size battery common to the boat or recreational vehicle industry. Electrical current protection and switch is provided by a circuit breaker 24 or equivalent. Installation wiring is simple and common to the art. Temperature sensing is provided by an external thermal sensor 6. This unit is common to the industry providing economical and reliable operation. Over-temperature protection is achieved by a resettable thermal sensor 8. This sensor is also common to the industry. Both of the sensors are attached to the said tank 2 by a tab and screw. The high efficiency hot water heater has installed a fixed lower insulated divider 10, which in function isolates 2 gallons of water which facilitates a relatively rapid rise in temperature of the water. The said lower divider 10 has a hole of approximately ½" diameter on one corner for the purpose of controlled heat transfer to the upper tank water. This ½" diameter hole also provides a means for the upper tank water to drain into the lower tank water. Shown is a floating insulated divider 12. When the said water tank 2 is filled or drained the said divider 12 floats on top of the water. This divider provides an additional layer of insulation and reduces heat loss to the air that fills the upper chamber as it is emptied. The said floating divider 12 also blocks the filler port 14 when the tank 2 is filled reducing heat loss through the inlet. A reflective aluminum coating 16 is installed on the side walls and bottom of said tank. This coating reflects heat into the water reducing radiational heat loss and assists in protecting the tank 2 from the direct high temperature of the heater probe 4. The tank's 2 exterior foam insulation 22 is shown to provide heat retention and improve thermal efficiency. An external jacket 18 is shown which provides a means of fastening the said water heater 0 to a floor or shelf. The jacket also provides mechanical protection as well as enhancing the cosmetic appearance. In normal usage the said water heater 0 will be filled with water at the filler port 14 until full at which time the upper floating divider 12 will be flush with the top of said tank 2. The heater probe 4 is turned on by circuit breaker 14 or thermal switch 6. The water temperature is raised in the lower chamber to 105° F. at which time the thermal sensor 6 removes electrical power. This heated water is ready for immediate use. The lower chamber heated water continues to mix with the upper chamber by way of the ½" diameter hole in the lower fixed divider 10. When the water temperature in the lower chamber drops to a predetermined value the heater probe is automatically switched on to again raise the temperature in the lower chamber. By so doing the water temperature in the upper chamber is raised in a controlled fashion. This heating cycle is preferred to minimize strain on the battery, if so installed. The heated water is drawn out as desired at the exit fitting 20 by pump or gravity.

What is claimed is:

1. An electrically powered hot water heater for a vehicle including a heating element adapted to be powered by a battery on the vehicle, said heater comprising a tank having an upper inlet for receiving water and a lower discharge port, a horizontally directed divider in said tank dividing said tank into upper and lower chambers, said divider providing limited communication between said upper and lower sections, said heating element extending into said tank in said lower chamber, said upper inlet being above said divider, said discharge port being below said divider, an electrical circuit including switching means for connecting said heating element to the battery, and water temperature sensing means in said circuit effective to disconnect said heating element from the battery when the temperature of the water in said lower chamber reaches a predetermined value.

2. The water heater of claim 1 further including means in the upper chamber of said tank for blocking said upper inlet when said tank is filled with water to prevent further ingress of water.

3. The water tank of claim 2 wherein said means in said upper chamber is a floating insulator in said upper chamber.

4. The water heater of claim 1 where said water temperature sensing means limits the water temperature to between ninety and one-hundred five degrees F.

5. The water tank of claim 1 wherein said heating element is installed in close proximity to the bottom of said lower chamber.

6. The water tank of claim 1 where the interior of said tank is lined with a reflective coating.

7. The water tank of claim 1 wherein the walls of said tank are insulated.

* * * * *